United States Patent [19]

Hewson

[11] 4,253,649

[45] Mar. 3, 1981

[54] ADJUSTABLE WORK POSITIONING TOOL

[76] Inventor: Andrew J. Hewson, 1109 Sydney Rd., Coburg, 3058, Victoria, Australia

[21] Appl. No.: 88,092

[22] Filed: Oct. 24, 1979

[30] Foreign Application Priority Data

Oct. 30, 1978 [AU] Australia ..... PD6576

[51] Int. Cl.[3] ..... B25B 1/22

[52] U.S. Cl. ..... 269/45; 269/82; 403/97

[58] Field of Search ..... 269/45, 71–72, 269/82–85; 403/96, 97

[56] References Cited

U.S. PATENT DOCUMENTS

| | | | |
|---|---|---|---|
| 1,089,337 | 3/1914 | Graham | 403/97 |
| 1,670,253 | 5/1928 | Gilbert et al. | 269/82 |

*Primary Examiner*—Robert C. Watson

*Attorney, Agent, or Firm*—Andrus, Sceales, Starke & Sawall

[57] ABSTRACT

A tool comprising a first body, a shaft mounted to the first body and rotatable about an axis extending through the first body and which is movable longitudinally with respect to the first body, a second body mounted to the shaft, and a clamp mounted to the second body and rotatable about an axis extending through the second body.

7 Claims, 5 Drawing Figures

ADJUSTABLE WORK POSITIONING TOOL

This invention relates to a tool.

There is a need for a tool capable of holding a work piece in a selected position in space. Still further, there is a need for a tool which can hold a workpiece and which is adjustable so that the position of the workpiece in space can be varied.

The present invention provides a tool comprising a first body, a shaft mounted to the first body and rotatable about an axis extending through the first body and which is movable longitudinally with respect to the first body, a second body mounted to the shaft, and a clamp mounted to the second body and rotatable about an axis extending through the second body.

Preferably, the second body is secured to the shaft to be rotatable about an axis generally perpendicular to the shaft.

Preferably a third body is mounted to the first body and is rotatable about an axis extending through the first body. The last mentioned axis is preferably generally at right angles to the first mentioned axis.

The third body preferably has a shaft mounted thereto. The last mentioned shaft is preferably rotatable about an axis extending through the first body and the last mentioned axis is preferably generally at right angles to the axis about which the third body is rotatable. The last mentioned shaft is preferably movable longitudinally with respect to the third body.

A fourth body is preferably mounted to the last mentioned shaft and is preferably rotatable about an axis generally perpendicular to the last mentioned shaft. A clamp is preferably mounted to the fourth body and is preferably rotatable about an axis extending through the fourth body.

Lock means is preferably provided to releasably lock various parts of the tool in desired configurations and/or conformations.

A plate may be secured to some part of a tool to enable it to be mounted to a vice, bench or any other convenient member.

The tool preferably comprises a joint formed of two axially disposed discs between which is disposed a friction member such that by forcing the discs together they can be restricted against rotation relative to one another. However, applicant has found that in the context of the present invention substantial forces can be exerted on the shafts which result in the discs relatively rotating even when strongly forced towards one another. In seeking to overcome this problem applicant has used discs of 10 cm. diameter and although these did resist rotation better than smaller discs their size made them impractical. Various other solutions were tried but were found to be either impractical or to add substantial expense.

However, applicant has also found that such discs are preferably mounted to bodies forming part of the tool, which bodies may include a shaft, and that a practical method of mounting is welding and that a particularly practical method of welding is spot welding. Applicant has also found that the spot welding can be conducted so as to produce a depression in the side of the discs which is to be adjacent the friction member. Such a depression has been found to produce substantial resistance against relative rotation of the discs.

Accordingly, in one aspect this invention provides a joint comprising two axially disposed discs, a friction member sandwiched between the discs, means for forcing the discs towards one another and wherein at least one of the discs is spot welded to a body and has a depression therein formed by the spot welding adjacent the friction member. A suitable depression has a diameter of from 2–10 mm with about 6 mm being most preferred and a depth of ½–2 mm. With such a depression I have found that adequate resistance to relative rotation can be had with discs down to about 25 mm diameter although a diameter of about 40–50 mm is more preferred.

It is preferred that the friction member is a resilient member such as a natural or synthetic elastomer such as rubber.

A specific construction of tool in accordance with this invention will now be described with the aid of the accompanying drawings in which.

Figures 1, 2, 3:
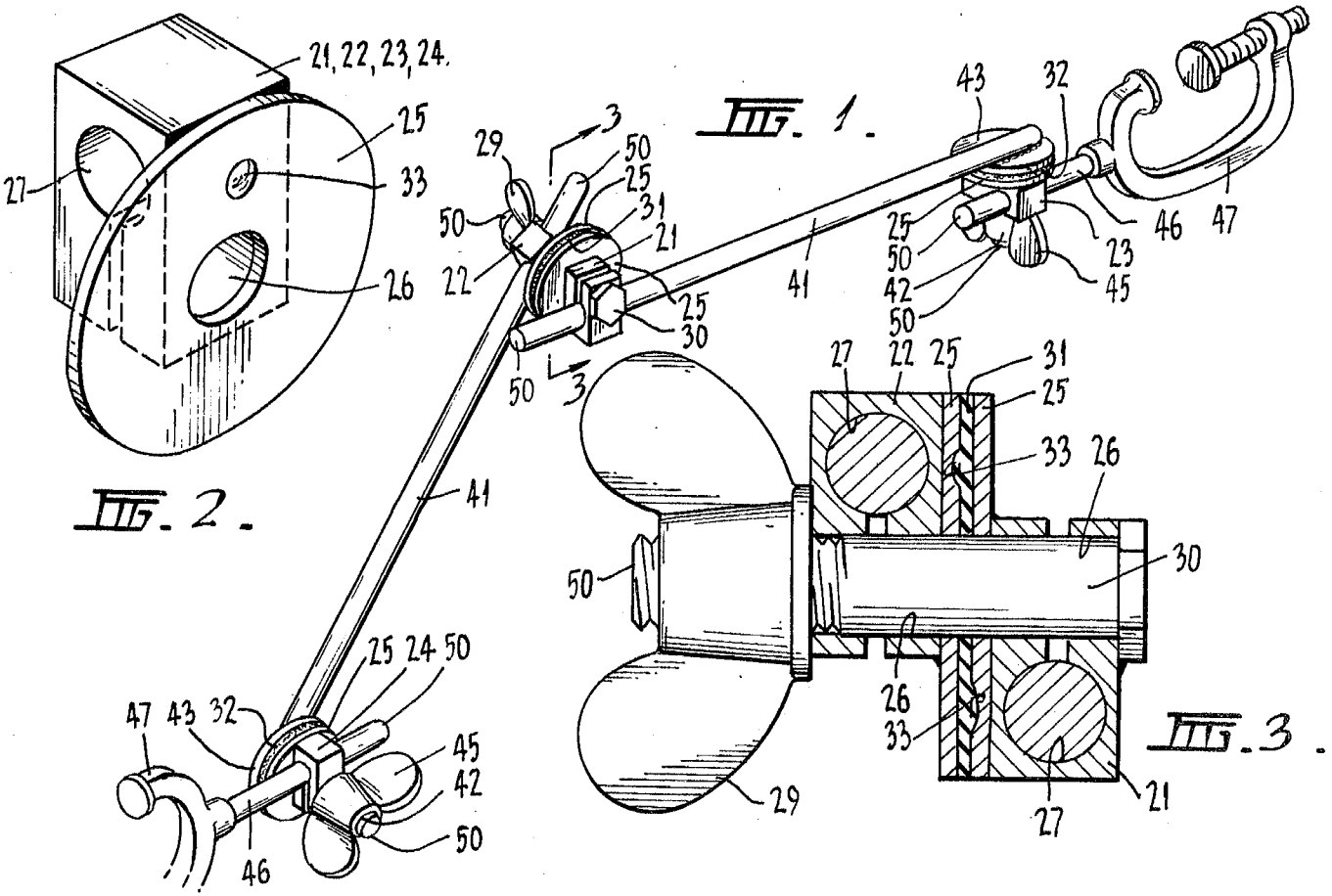
FIG. 1 is a perspective view of a tool in accordance with this invention.
FIG. 2 is a perspective view of part of the tool.
FIG. 3 is a cross-section on line 3—3 in FIG. 1.
Figure 4:
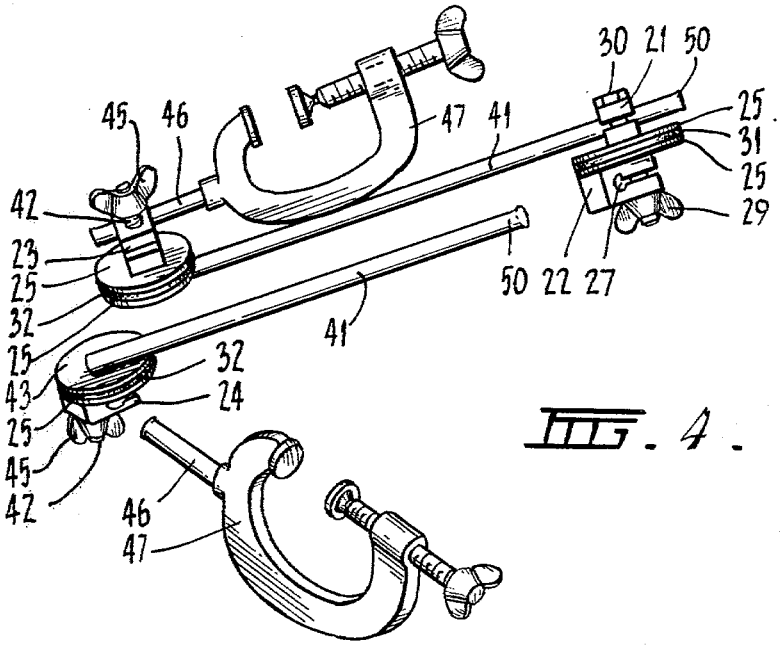
FIG. 4 is another perspective view of the tool but in partly exploded view.

The tool shown in FIG. 1 comprises substantially identical bodies 21, 22, 23 and 24, each of which has a friction washer 25 secured thereto by spot welding, a through bore 26 and a clamping bore 27.

Bodies 21 and 22 are located by means of bores 26 on a bolt 30 fitted with a wing nut 29. Each washer 25 is adjacent one side of a rubber friction member 31. By tightening or loosening the wing nut 29 the bodies 21 and 22 can be prevented or permitted to relatively rotate with respect to one another about the axis of the bolt 30.

Further tightening or loosening of the wing nut 29 will restrict or open the bores 27.

Received in each bore 27 of bodies 21 and 22 is a shaft 41. By loosening or tightening the wing nut 29 the shafts 41 can be permitted or prevented from rotating in and moving longitudinally through the respective one of bodies 21 and 22.

Each shaft 41 carries a shank 42 fitted with a washer 43 which is spot welded to the respective shaft 41 and on which shanks 42 are respectively fitted rubber friction members 32, washer 25, bodies 23 and 24, and wing nuts 45.

Within the bores 27 of bodies 23 and 24 are received shanks 46 attached to G-clamps 47.

By tightening or loosening the wing nuts 45 the bodies 23 and 24 can be permitted or prevented from rotating on the shanks 42 and the G-clamps 47 can be permitted or prevented from rotating and moving longitudinally through the bores 27 of the respective one of bodies 23 and 24.

Accordingly, the various parts of the tool can be freed or prevented from moving and it will be realized that the tool can take up a plurality of orientations.

To ensure that the tool does not come apart it may be desirable to peen, burr or otherwise treat one or more of the ends 50 so that the parts may not be dismantled.

The spot welding of the washers 25 to the bodies 21 and 22 is shown in FIGS. 2 and 3. The spot welding was conducted to form depressions 33 in the surfaces of the washers 25 which are adjacent the friction member 31. As a result of the depressions 23 when the wing nut 29 is tightened the friction member 31 will deform into the depressions and this produces more resistance to relative rotation of the bodies 21 and 22 than if the depressions 33 were not present.

In a preferred instance, the washers 25 have an area of from 300 sq. mm. to 3000 sq. mm. and the depressions 33 have an area of from 10 to 200 sq. mm. and a depth of 0.5 to 3 mm.

The washers 43 are preferably spot welded to the shafts 41 and the washers 25 are preferably spot welded to the bodies 23 and 24 to obtain similar depressions to depressions 33 for a similar reason.

Figure 5:
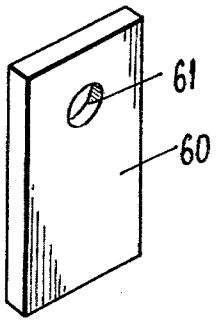
FIG. 5 is a perspective view of an accessory which can be used with the tool.

In FIG. 5 is shown a plate 60 having a hole 61 therein. The plate 60 may be mounted on a selected one of the bolt 30 and shanks 42 and secured there by the appropriate wing nut 29 or 45. When so mounted the plate 60 may be clamped in a vice or to a bench by a separate clamp.

Various modifications may be made to the above described in that the washers 25 may be welded to the bodies 21–24 in a number of places, the wing nuts 29 and 45 may be replaced by conventional nuts and the G-clamps 47 can be otherwise secured to the bodies 23 and 24.

FIGS. 2–7 show slightly different tools and different ways of using the tools and the most significant difference is the mounting of a plate 60 to bolt 30 to enable various manners of use.

Modifications and adaptations may be made to the above described without departing from the spirit and scope of this invention which includes every novel feature and combination of features disclosed herein.

The claims form part of the disclosure of this specification.

I claim:

1. A tool comprising clamp means and a joint, said joint comprising a first body to which the clamp means is secured and a second body, means mounting the first and second body for relative rotation about an axis and for forcing the first and second bodies towards one another, a disc carried by each of the first and second bodies, said discs being axially disposed with respect to one another, a resilient friction member sandwiched between the discs, and wherein the discs are spot welded to the respective one of the first and second bodies and have a depression therein formed by the spot welding adjacent the friction member said depression being spaced from the axis of rotation of said first and second bodies and coacting with said friction member to prevent relative rotation of said first and second bodies.

2. A tool as claimed in claim 1, wherein the friction member is a natural or synthetic elastomer.

3. A tool as claimed in claim 1, wherein the depression in the first body is located at a first radial distance from said axis and the depression in the second body is located at a second, different, radial distance from said axis.

4. A tool as claimed in claim 1, wherein the clamp means includes a G-clamp having a shaft extending in a direction parallel to the axis of the screw of the G-clamp and which shaft extends through the first body and is mounted for rotation about an axis co-incident with the axis of the shaft.

5. A tool as claimed in claim 4, wherein said means mounting the first and second bodies is adapted to be moved to restrict the shaft against rotation in said first body.

6. A tool as claimed in claim 1, including a second shaft mounted to the second body and to a second said joint, said shaft being mounted to the first body of said second joint.

7. A tool as claimed in claim 6, including a third shaft mounted to the second body of said second such joint, on which third shaft is mounted a third such joint by means of the second body thereof and wherein the first body of said third such joint has a second clamp means secured thereto.

* * * * *